United States Patent [19]

Borodulin et al.

[11] Patent Number: 4,705,029

[45] Date of Patent: Nov. 10, 1987

[54] EXPANDABLE URETHRAL BOUGIES

[76] Inventors: German Borodulin, 2518 Clement St., #4, San Francisco, Calif. 94121; Maxim Persidsky, 35 Temescal Ter., San Francisco, Calif. 94118; Alexander Shkolnik, 962 El Camino Real, #202, San Mateo, Calif. 94402

[21] Appl. No.: 896,810

[22] Filed: Aug. 15, 1986

Related U.S. Application Data

[60] Continuation-in-part of Ser. No. 861,871, May 12, 1986, abandoned, which is a division of Ser. No. 778,760, Sep. 23, 1985, Pat. No. 4,607,626, which is a continuation-in-part of Ser. No. 621,842, Jun. 18, 1984, abandoned.

[51] Int. Cl.[4] ..... A61H 1/00

[52] U.S. Cl. ..... 128/43; 128/345; 604/105

[58] Field of Search ..... 128/60, 43–44, 128/51–52, 79, 303 R, 303.11, 311, 341, 343, 344, 345; 604/104–109, 14, 22, 264, 274, 280, 283

[56] References Cited

U.S. PATENT DOCUMENTS

| | | | |
|---|---|---|---|
| 1,191,683 | 7/1916 | Finley | 604/107 |
| 3,495,586 | 2/1970 | Regenbogen | 128/345 |
| 3,741,214 | 6/1973 | Tillander | 128/341 |
| 4,043,338 | 8/1977 | Homm et al. | 604/105 |
| 4,154,242 | 5/1979 | Termanini | 204/105 |
| 4,432,758 | 2/1984 | Finegold | 604/104 |
| 4,535,759 | 8/1985 | Polk et al. | 128/343 |

FOREIGN PATENT DOCUMENTS

| | | | |
|---|---|---|---|
| 73751 | 9/1917 | Austria | 128/345 |
| 458663 | 4/1928 | Fed. Rep. of Germany | 128/345 |
| 640126 | 12/1936 | Fed. Rep. of Germany | 604/105 |
| 185899 | 9/1887 | France | 128/341 |
| 520263 | 6/1921 | France | 604/105 |
| 265400 | 11/1929 | Italy . | |

*Primary Examiner*—E. H. Eickholt
*Attorney, Agent, or Firm*—David Pressman

[57] ABSTRACT

A mechanically-expandable instrument (bougie), especially useful for treating diseases in the urethra and the neck of the urinary bladder, comprises an adjustable-speed driving unit (20) and a probe (22) composed of two rods (64) and (66) pivotally connected together at one end thereof and attached to output sliders (54, 56) of the driving unit at their other ends. Each of the rods (64) and (66) has a semicircular cross section so that in an assembled state the probe has a complete circular cross section. Reciprocations of the sliders cause expansions and contractions of the probe, thereby to stretch urethral constrictions in the radial direction and to subject the urethra and its surrounding tissue to massaging and vibrational actions which are extremely efficient for treating diseases of the urethra and the neck of the urinary bladder. Other embodiments of the rod employ cams, wedges, and threaded means for creating radial expansions and contractions of the probe.

4 Claims, 24 Drawing Figures

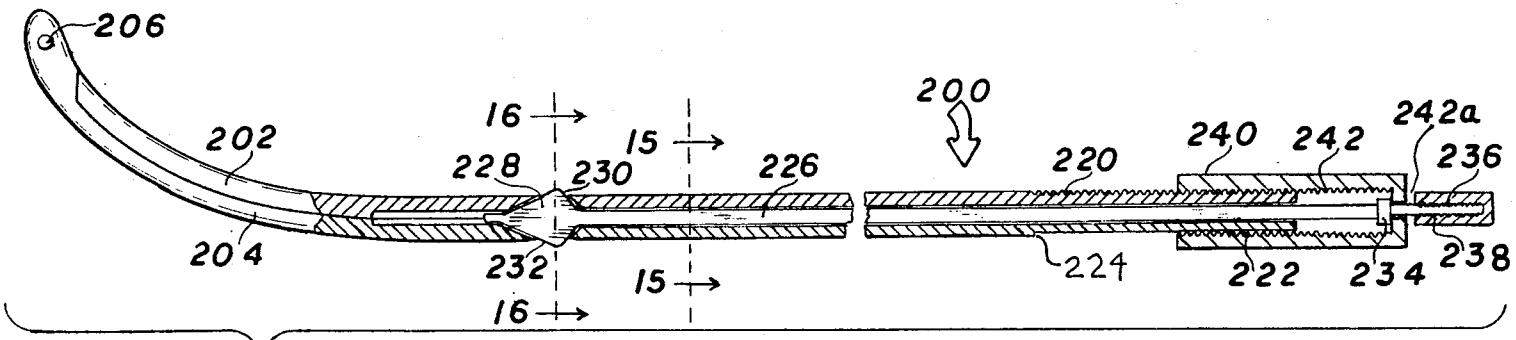
FIG 14
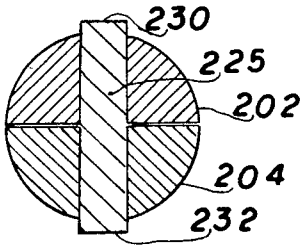
FIG 15
FIG 16
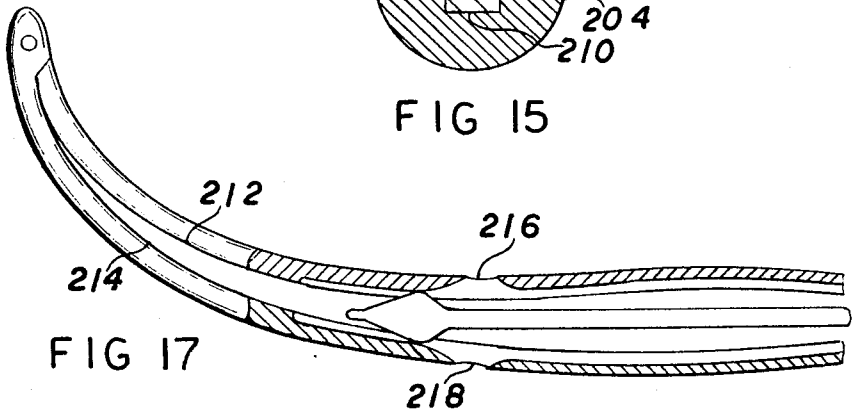
FIG 17

EXPANDABLE URETHRAL BOUGIES

CROSS-REFERENCES TO RELATED APPLICATIONS

This fourth application is a continuation-in-part of a third application, Ser. No. 861,871, filed May 12, 1986 now abandoned.

Said third application is a division of a second application, Ser. No. 778,760, filed Sept. 23, 1985 now U.S. Pat. No. 4,607,626, granted Aug. 26, 1986.

Said second application is a U.S. continuation-in-part of a first application, Ser. No. 621,842, filed June 18, 1984, now abandoned.

BACKGROUND

1. Field of the Invention

This invention relates to medical instruments, particularly to urological probes (bougies) for treating diseases of the urethra and the neck of the urinary bladder.

2. Description of Prior Art

Urethral strictures, especially postraumatic ones, are very dense, rigid, and resistant to stretching. They are localized mostly in the membranous or bulbous parts of the urethra.

A non-surgical method for treating urethral strictures, known as bouglurage, involves probing such strictures with elongated members or probes to enlarge them.

Such probes are known as bougies and prior-art, conventional bougies are shown, e.g., in the text "Urology", 3d ed., v.1. p. 242, M. F. Campbell and J. H. Harrison, eds. (Saunders, 1970). They comprise solid metal (or plastic) rods which are shaped to accommodate the physiological curvature of the urethra. Since in males the urethra's outer part is within the pendulus of penis, which is highly flexible, such outer part can be bent or straightened as necessary. The urethra's inner part extends around (behind) the pubic articulation and thus is curved. Thus, conventional bougies generally comprise a straight portion extending from the handle, followed by a curved portion adjacent the tip. This shape corresponds to the urethra when the penis is straightened, i.e., starting at its penile outlet, the urethra is straight and then curved (roughly C-shaped).

Despite the correspondence in shapes, the insertion of a conventional bougie in males is a very complicated and painful operation, requiring high skill and concentration. Usually, the urologist will employ a set of bougies of gradually increasing diameter. The results of treatment with such instruments are not always positive; complications such as bleeding, injuries, urinary fever, prostatitis, epididymitis, urethremorrharia, etc., may occur. Even in females, whose urethreas are shorter and straighter, many of these difficulties are encountered.

Moreover, the conventional bougie is used only for dilatation and cannot be utilized for other types of treatment, e.g. inner massage of the urethra and/or neck of the urinary bladder, and dilatation of nephrostomic fistulae.

OBJECTS AND ADVANTAGES

Accordingly, one main object of the invention is provide an improved bougie for treating strictures. Other objects are to provide an improved bougie for treating urinary bladder neck diseases and impotence. Further objects are to provide bougies which can be used more efficiently and universally, which are more reliable in operation, and which are adjustable and simple to manufacture. Still further objects are to provide a bougie which can be used singly, which is less painful for the patient during treatment, and which causes fewer injuries or complications. Yet further objects are to provide bougies of a reduced diameter so that insertion into the urethra is facilitated, to provide bougies which can massage and provide desirable vibrational effects on urethral strictures, their surrounding tissue and the neck of the bladder, to provide bougies which can be used for dilatation of nephrostomic fistulae, and to provide expandable instruments. Other objects and advantages invention will become apparent from a consideration of the ensuing description and drawings.

BRIEF DESCRIPTION OF DRAWINGS

FIG. 14 shows a cross-sectional view of a bougie according to a fifth embodiment of the invention where expansion is obtained by longitudinally moving protruding wedge.

FIGS. 15 and 16 show cross-sectional views taken along the lines 15—15 and 16—16 of FIG. 14.

FIG. 17 shows a partial sectional view of the bougie of FIG. 14 in an expanded condition.

REFERENCE NUMERALS

Figure 1:
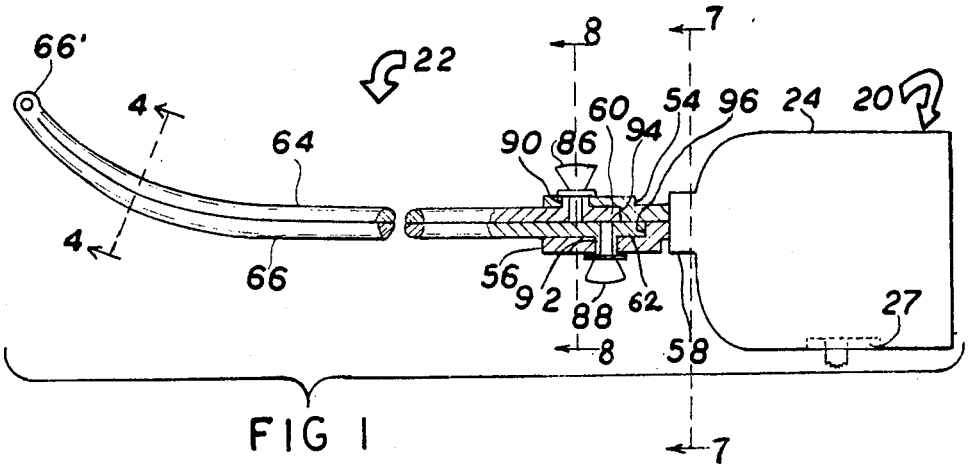
FIG. 1 is a general side, partially-sectional view of a mechanically-driven bougie of the invention where expansion is obtained by shortening flexible rods.

20—drive unit
24—housing
54—slider
58—guide portion
64, 66—rods
68, 70—shank portions
74—protruding portion
82, 84—through holes
90, 92—holes
100—probe
104, 106—cams
130—probe
22—probe
27—sliding knob
56—slider
60, 62—recesses
66'—pivot pin
72—slot
78, 80—mating surfaces
86, 88—screws
94, 96—stop surfaces
102—tip
108, 110—rods
132, 134—rods
136, 136'—recesses
140—core
144, 146—grooves
150—threaded portion
154—handle
158, 158'—cams
162, 164—rods
202, 204—rods
208, 210—longitudinal grooves
216, 218—holes
222—non-threaded portion
225—large-diameter portion
228—wedge
234—collar
238—nut
242—inner threading
300—bougie
311—tongue
**313*a*, 313*b***—camming surfaces
315—square opening
314—adhesive substance
320, 322—mating surfaces
326—central rod
332, 334—camming lobes
340, 342—symmetric lobes
348, 350—projections
356, 358—inwardly-directed ribs
362—part of rod
366—threaded portion
370—cylindrical head
**370*a***—scale
378—support surface
381—split part
386—abutting surface
138, 138'—wedges
142—recess
148—nut
152—hole
156—bolt
160—core
200—bougie
206—pivot pin
212, 714—inner surfaces
220—thread
224—shoulder
226—core element
230, 232—lobes
236—thread
240—sleeve
**242*a***—opening
310, 312—rods
**311*a***—inclined groove
**315*a*, 315*b***—camming surfaces
317—tooth
316, 318—guide grooves
324—guide slot
328, 330—wedge elements
336, 338—through holes
344—handle
352, 354—inwardly directed ears
360—gap
364—through opening
368—longitudinal slot
372—inner thread
376—collar
380—threaded bore
382—rear end hole
388—recess.

FIG. 1—MECHANICALLY-EXPANDABLE BOUGLE

Figure 2:
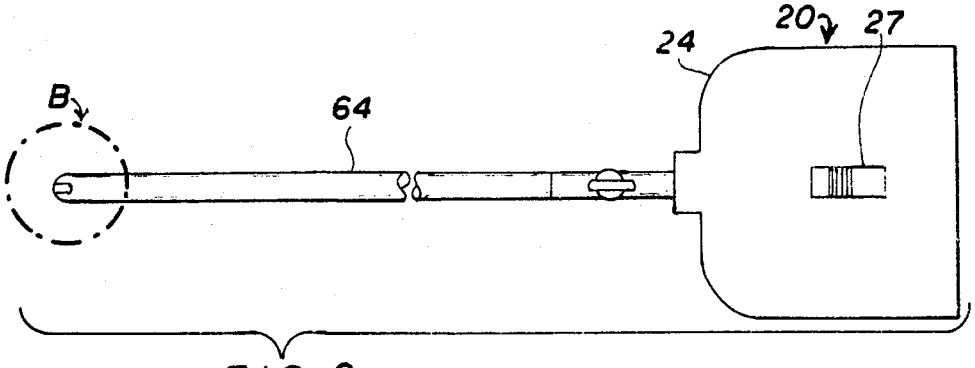
FIG. 2 is a general view of the bougie of FIG. 1.

According to one embodiment of the invention, a bougie has a mechanically-expandable probe. As shown in FIGS. 1 and 2, the bougie consists generally of two main units, i.e., a drive unit 20 and a probe 22 which is attached to drive unit 20 in a manner described in detail below.

Drive unit 20 may be a conventional commercially available device, such as a drive unit for an electric knife with two blades which reciprocate in opposite directions. Unit 20 includes a housing 24 with an electric motor (not shown) and a supply cord (not shown), for connection to a conventional electric power source (not shown), preferably a storage battery, to prevent electric injuries in a case of shorts and patient grounding. The rotational speed of the motor may be adjusted, e.g. by means of a sliding knob 27 which controls a speed control (not shown).

Figure 7:
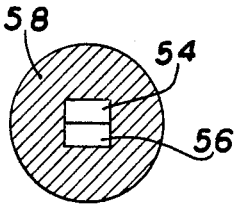
FIG. 7 is a cross-sectional view along lines 7—7 of FIG. 1.

Unit 20 has two output sliders 54 and 56 which protrude from a tubular output end 58 of housing 24 (FIG. 7). When the instrument is operated, sliders 54 and 56 reciprocate in opposite directions, their speed being controlled by knob 27. Housing 20 may also include stroke-length adjustment means (not shown). The sliders have recesses 60 and 62, respectively (FIG. 1), for receiving the shank portions of probe 22, which will be now described.

Figure 8:
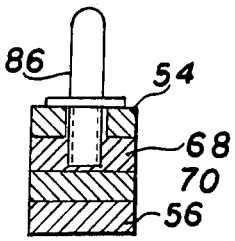
FIG. 8 is a cross-sectional view along lines 8—8 of FIG. 1.

Probe 22, the insertable part of the bougie, consists of two flexible, tapering rods 64 and 66 of semicircular cross sections (FIG. 4), except for their shank portions 68 and 70 which are thicker and more rigid and which have rectangular cross sections, as shown in FIG. 8, so as to be accommodated in rectangular recesses 60 and 62 of sliders 54 and 56, respectively. Preferably rods 64 and 66 are made of stainless steel and are about 30 mm long and 4.5 mm in diameter.

Figure 5:
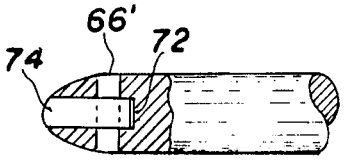
FIG. 5 is an enlarged view of element B of FIG. 2.

The front ends of rods 64 and 66 are pivotally connected to each other by a pivot pin 66'. As shown in FIG. 5, which is an enlargement of area B of FIG. 2, either rod 64 or rod 66 has a fork-shaped end with a slot 72. A protruding portion 74 of the complementary rod is inserted into this slot so that both rods 64 and 66 can be pivotally interconnected by a pin 66'.

Figure 4:
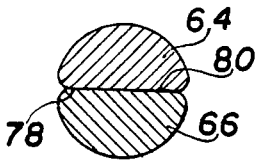
FIG. 4. is a cross-sectional view along lines 4—4 of FIG. 1.

As shown in FIG. 4, in a folded or working state, rods 64 and 66 form a complete circle when seen in cross section, except for chamfered or rounded edges at opposite sides on mating surfaces 78 and 80; these prevent pinching of mucosa during operation of the tool. The front end of probe 22 is also rounded. Thus in its working or folded state, the probe corresponds in its shape to a conventional bougie. However, it is made smaller in diameter than a conventional bougie because it has a capacity to expand, as explained infra. In fact, it corresponds in size to the smallest bougie of a conventional set and thus can be easily inserted into the urethra. Moreover it can act inside the urethra as or more efficiently than the largest diameter bougie in a conventional set due to its ability to provide vibrational and massaging effects to strictures and their surrounding tissue. Also, as with a conventional bougie, it has a diameter which gradually narrows and flattens towards the tip so as to facilitate insertion.

Figure 3:
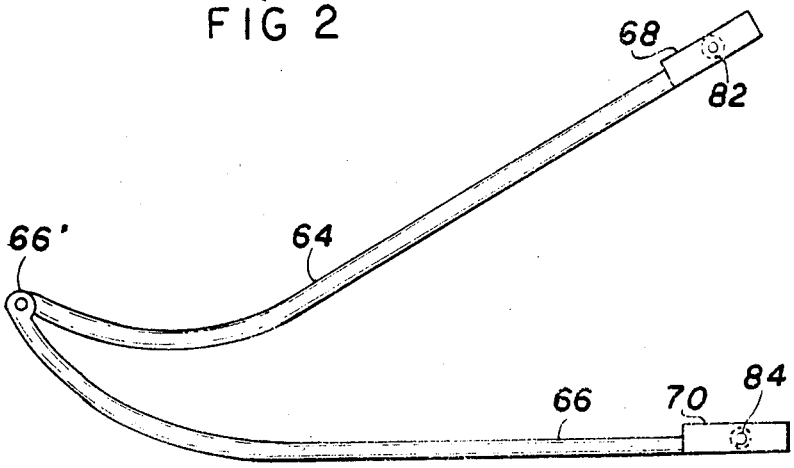
FIG. 3 is a view of a probe of the bougie of FIG. 1.

In its rectangular shank portions 68 and 70, rods 64 and 66 have threaded holes 82 and 84 (FIG. 3). Screws 86 and 88 are threaded through holes 82 and 84 and mate with corresponding holes 90 and 92 in the protruding portions of sliders 54 and 56. These screws and holes are used for attachment of rods 64 and 66 to their respective sliders. In recesses 60 and 62 of the sliders, stop surfaces 94 and 90 are provided. The ends of shank portions 68 and 70 rest against these stops in order to align threaded holes 82 and 84.

Probe 22 can be made of any suitable material which is durable, flexible, and hygenically acceptable for sterilization and insertion into the urethra. For example, it can be made of stainless steel or plastic, such as polycarbonate, PFTE, etc.

FIGS. 1 TO 8—OPERATION

Probe 22 is folded and is attached to drive unit 20 by means of screws 85 and 88. For this purpose, shank portions 68 and 70 are pressed against stop surfaces 94 and 96 of respective sliders 54 and 56, whereupon threaded holes 82 and 84 will be aligned with holes 90 and 92 of the sliders. Each shank is attached to its corresponding slider by screws 86 and 88, respectively.

For treating a patient, e.g., for dilating a stricture in the urethra, probe 22 is inserted into urethra of the patient in the usual manner with the motor of drive unit 20 still off. This procedure is made less painful and less dangerous because of the smaller diameter of bougie 22.

When the expandable part of probe 22 reaches the constricted portion of the urethra, the motor of driving unit 20 is turned on. When the motor rotates, slides 54 and 56 will reciprocate in mutually opposite directions.

Figure 6:
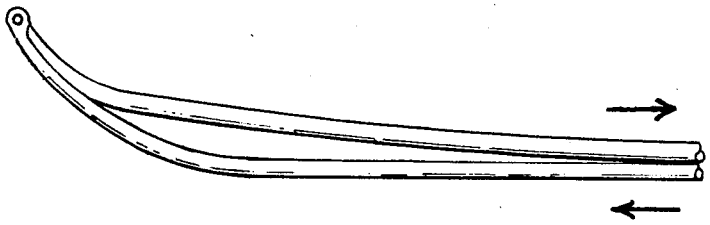
FIG. 6 is a working portion of the bougie of FIG. 1 in an expanded position.

As a result of their mutually opposite reciprocations, their flexibility, and their tip attachment by pivot pin 66', the front portions of rods 64 and 66, which are highly flexible due to their reduced diameter, will be repeatedly forced to separate from each other, i.e., they will repeatedly assume the separated positions shown in FIG. 6 and then contract, thereby expanding and contracting probe 22 radially.

Specifically, when the upper rod is pulled back toward the motor and the lower rod is pushed forward as indicated in FIG. 6, the force will tend to shorten the upper rod, which will remain straight. However, the lower rod, being fixed at its distal tip by reason of its connection to the upper rod and being pushed out from its proximate end, will tend to lengthen and thus will bow out at its most flexible free part, i.e., near its tip.

Thereafter lower rod 66 will be pulled back and upper rod 64 pushed out, causing both rods to straighten, and then causing the lower rod to bow and the upper rod to straighten (not shown), and so on.

These expansions and contractions will occur at a frequency controlled by knob 27 on the housing of driving unit 20. The frequency is selected according to the type of treatment being given to the patient (dilatation of the stricture, massage of the urethra, massage of the neck of the bladder, etc.), but usually it should be within the limits of from 5 to 60 Hz, preferably, from 10 to 30 Hz. The duration of treatment also can vary, depending on many factors, such as the type of disease, condition of the patient, etc.

When the procedure is over, the motor is turned off and probe 22 is extracted from the urethra. After extraction, the actuating tool is disconnected from drive unit 20, sterilized, and is ready for reuse.

FIG. 9—BOUGIE WITH OVERRIDING CAMS

Figure 9:
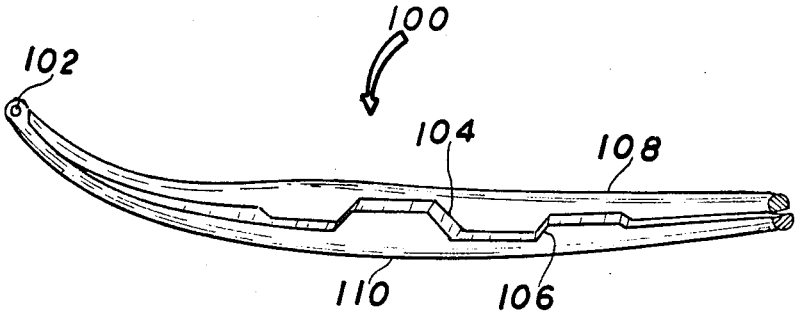
FIG. 9 is a side view of a bougie according to a second embodiment of the invention where expansion is obtained by sliding adjacent integral cams on respective rods against each other.

In some patients urethral constrictions may have a considerable length. For treating such patients, the tool of FIG. 9, which uses overriding cams, is most suitable.

The mechanically driven tool of this embodiment has the same drive unit 20 as used in the embodiment of FIGS. 1 and 2 and differs only in its probe 100.

Probe 100 has two rods 108 and 110. At its proximal part, remote from tip 102, mutually engaging cams 104 and 106 are formed on the mating surfaces of rods 108 and 110.

During operation of the tool, rods 108 and 110 reciprocate in mutually opposite directions. This causes cam 104 of rod 108 to override cam 106 of rod 110, causing the rods to expand in the vicinity of the tip portion and in the region of cams 106 and 104. Thus a longer portion of the probe expands and contracts, enabling a longer portion of the urethra to be treated. The insertion, control, and extraction of the tool are carried out in the same manner as has been described for the first embodiment of the invention.

FIGS. 10 AND 11—MANUALLY-ROTATABLE BOUGLE WITH WEDGES

Figure 10:
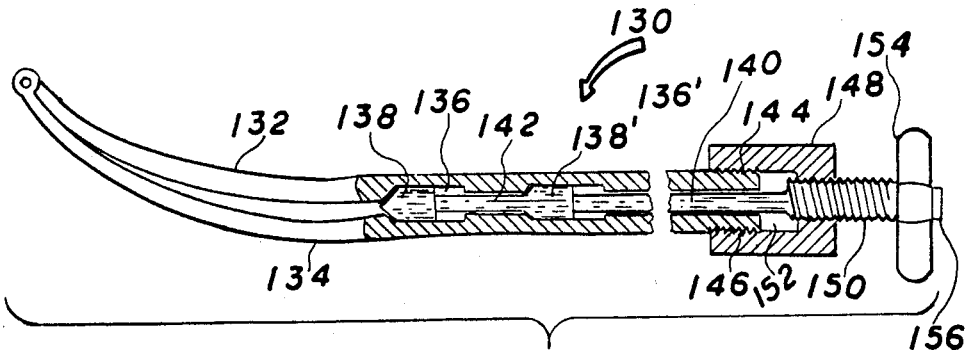
FIG. 10 is a longitudinal partially-broken view of a bougie according to a third embodiment of the invention where espansion is obtained by longitudinally moving an internal wedge.
Figure 11:
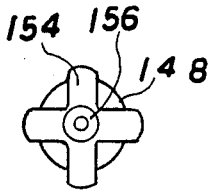
FIG. 11 is a view taken from the right side of FIG. 10.

A third embodiment of a manually-driven mechanically-expandable bougie is shown in FIGS. 10 and 11. FIG. 10 is a longitudinal, partially-broken-away view of a probe 130. As in the previous modification, probe 130 consists of a pair of pivotally interconnected rods 132 and 134 of a semicircular cross-section which together form a complete circle. Recesses 136 and 136' are formed in the respective rods so that in an assembled state, these recesses form closed cavities which accommodate cams or wedges 138 and 138', respectively. Wedges 138 and 138' are attached to a rigid core or rod 140 which passes through a smaller diameter recess 142 formed between rods 132 and 134.

The rear end of core 140 protrudes outside probe 130. The rear ends of rods 132 and 134 have grooves 144 and 146 which cooperate to form a complete thread when the bougie is assembled. A nut 148 is screwed onto this thread in order to fix the proximal end of the bougie and at the same time to provide a handle for a urologist who uses the bougie. The shape of this handle is shown in FIG. 11, a view taken from the right side in FIG. 10.

The protruding end of core 140 is threaded at 150 so that it can be mate with the inner thread in the hole 152 of nut 148 through which core 140 protrudes. The rear end of core 140 has a handle 154 rigidly attached thereto, e.g., by a bolt 156.

In operation, bougie 130 is inserted into the urethra in a conventional manner and then is expanded mechanically by rotating handle 154 in the direction which provides forward movement of wedges 138 and 138'. In the course of its forward movement, the wedges will cause rods 132 and 134 to move apart, thereby increasing the diameter of the probe. Handle 154 is repeatedly rotated in forward and reverse directions for periodically expanding and constricting the probe, thereby to impart a massaging action to the surrounding tissue of the urethra.

FIGS. 12 AND 13—MANUALLY-OPERABLE BOUGIE WITH ROTATABLE CAMS

Figure 12:
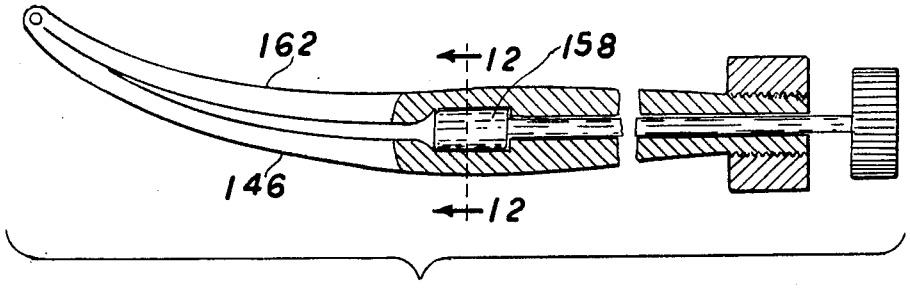
FIG. 12 is a view of a bougie according to a fourth embodiment of the invention where expansion is obtained by rotating an internal cam.
Figure 13:
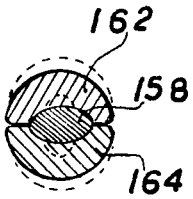
FIG. 13 is a cross-sectional view along lines 12—12 of FIG. 12.

FIGS. 12 and 13 illustrate a fourth embodiment of a bougie of the invention. This embodiment is generally similar to the embodiment shown in FIGS. 10 and 11, but differs in that a rotatable cam or eccentric 158 is attached to a core 160 instead of reciprocating wedges 138 and 138'.

During manual forward and reverse rotation, cams 158 will rotate, causing semicircular rods 162 and 164 to expand, periodically assuming the positions shown by the broken lines in FIG. 13.

FIGS. 14 TO 17—BOUGIE WITH PROTRUDING WEDGE-DESCRIPTION

Another embodiment of a mechanically-expandable bougie, here with a protruding wedge, is shown in FIGS. 14–17.

FIG. 14 is a longitudinal sectional view of a bougie 200. It consists of a pair of rods 202 and 204 pivotally connected at their front ends by a pivot pin 206.

As shown in FIGS. 15 and 16. which are cross-sectional views along lines 15—15 and 16—16, respectively, both rods have a semicircular cross-sections so that in an assembled state of the bougie, they form a complete circle.

Longitudinal grooves 208 and 210 are formed on mating inner surfaces 212 and 214 (FIG. 17) of the rods. Aligned holes 216 and 218 (FIG. 17) are formed in the front portion of the bougie, i.e., at a distance from $\frac{1}{8}$ to $\frac{1}{3}$ of the length of the rods from the point of their pivotal interconnection. These holes extend from the bottom of respective grooves 208 and 210 to the peripheries of the respective rods.

Grooves 208 and 210 are shallower adjacent the front end of the bougie, ahead of holes 216 and 218, than they are behind these holes.

The rear end of rod 202 is threaded at 220. The other rod, 204, is not threaded at its rear end 222, but rather has a smaller diameter than the inner diameter of threads 220. A shoulder 224 is formed between smaller diameter portion 222 and larger diameter portion 225 of rod 204.

Rods 202 and 204 sandwich a longitudinal core element 226 in the guide slot formed by grooves 208 and 210; core element 226 can slide freely in this slot. This core element has a flat (two-sided) wedge portion 228 on its front end. Wedge portion 228 has opposing lobes 230 and 232. The width of wedge portion 228 exceeds the diameter of the rods in their assembled state. Thus when wedge portion 228 is aligned with holes 216 and 218, its lobes 230, 232 protrude outwardly beyond the peripheries of the rods. The height of these protruding portions is preferably between 0.06 to 1.20 mm.

The rear end of core element 226 has an annular collar 234 of a slightly larger diameter than the front part of the element. The rear end of element 226 behind the collar is threaded at 236. A nut 238 is screwed onto this threaded portion. As shown, the depth of the threaded hole in nut 238 is shorter than the threaded rear end of element 226, thus creating a gap (as shown) between nut 238 and sleeve 240.

Sleeve 240, which has inner threading 242, is screwed onto thread 220 of rod 202. Sleeve 240 has an opening 242a in its rear end. The diameter of this opening is smaller than the diameter of annular collar 234, but is larger than the external diameter of thread 236.

FIGS. 14 TO 17—OPERATION

The bougie shown in FIGS. 14 to 17, can be used in two different modes.

According to the first mode of operation, core element 226 is not used and thus is removed from the device. After insertion into the urethra, the bougie is expanded to a required diameter by merely rotating sleeve 240 clockwise when seen from the rear end of the device. When sleeve 240 is turned, it will move forward until its front end abuts shoulder 224. Rod 204, which has no thread to engage with inner thread 242 of sleeve 240, will remain stationary, whereas rod 202 will be pulled backward because its thread 220 engages with inner thread 242 of sleeve 240. This causes deformation of rod 204 and hence its expansion outwardly from rod 202. This expansion dilates the urethral stricture of the urethra itself.

In the second mode of operation, the bougie is used in combination with longitudinal core element 226.

First the bougie is assembled as shown in FIG. 14 so that wedge 228 is aligned with holes 216 and 218 and its lobes 230 and 232 project outward beyond the peripheries of the rods. The bougie is then accurately inserted into the urethra. Until the protruding lobes come into contact with the urethral stricture, the probe can be easily moved forward. The moment of contact of lobes 230, 232 with the stricture can be distinctly felt by the urologist and this will be a signal that the expansion operation should be commenced.

To accomplish this, sleeve 240 is manually rotated. Since the threads of sleeve 240 mate with threads 220 of element 226, sleeve 240 will move axially toward the front end of the bougie. Since the inner rear shoulder of sleeve 240 engages annular collar 234 of core element 226, axial movement of sleeve 240 will be transmitted to core element 226. Element 226 will thereupon move forward with respect to rods 202 and 204. Core element 226 is guided in the slot. Lobes 230 and 232 of element 226 will engage the edges of holes 216 and 218 and cam rods 202 and 204 outwardly. Expansion will take place because grooves 208 and 210 have a smaller depth at the front part of the probe, i.e., before the holes, and because of the wedging action of the core.

If difficulties occur in returning the core element to its initial position before extraction of the bougie from the urethra, nut 238 can be used as an auxiliary means to facilitate the return of the core element to its initial position.

FIGS. 18 TO 23—BOUGIE WITH MULTIPLE AND OFFSET WEDGES—DESCRIPTION

Another embodiment of a mechanically-expandable bougie, here with a shortenend rod, is shown in FIGS. 18 to 23.

Figure 18:
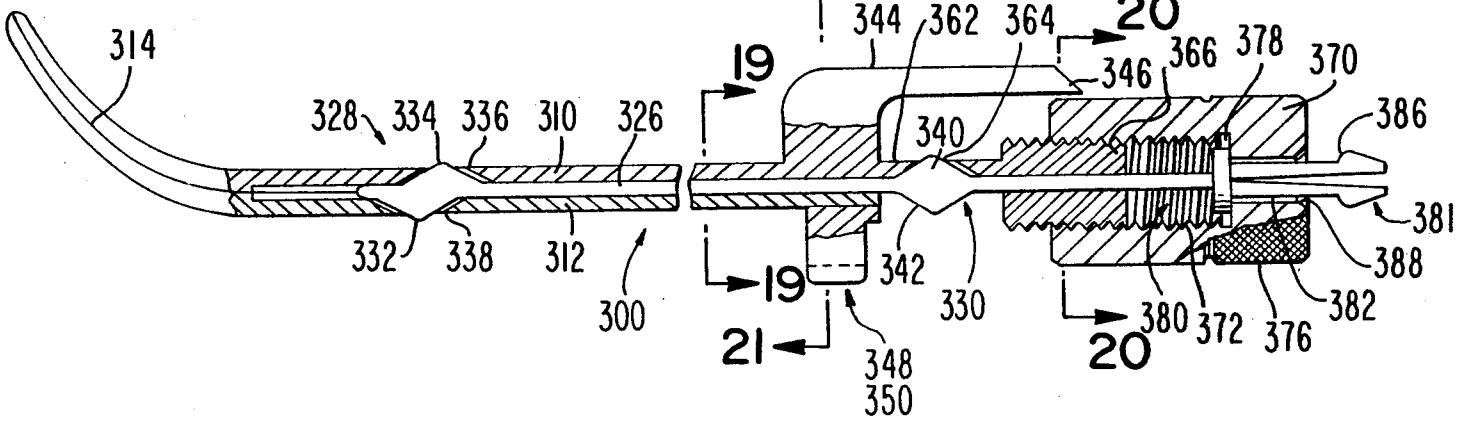
FIG. 18 shows a longitudinal sectional view of a bougie according to a sixth embodiment of the invention where expansion is obtained by longitudinally moving protruding multiple and/or offset wedges; a scale indicating the degree of expansion may be provided.

FIG. 18 is a longitudinal sectional view of a bougie 300. The bougie is formed of two rods 310 and 312. Each rod has a semicircular cross-section. When the rods are placed adjacent one another, flat sides facing, they form a complete circle. In their longitudinal view the rods in assembled state correspond to the shape of a conventional solid urological bougie, i.e., to the shape of the urethra. At their end distal from the actuating and holding and control end i.e., the left end in FIG. 18, such interconnection preferably is by means of a permanent or disconnectable pivot (in case of metal), or by thermal fusion of an adhesive substance 314 (FIG. 18) acceptable for medical applications (in case of plastic). The structure of the disconnectable pivot will be discussed later in connection with FIGS. 22 and 23.

Figure 19:
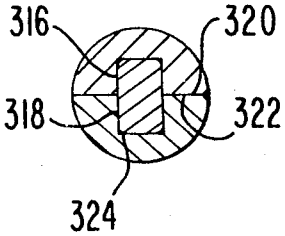
FIG. 19 is a cross-sectional view along the lines 19—19 in FIG. 18.
Figure 21:
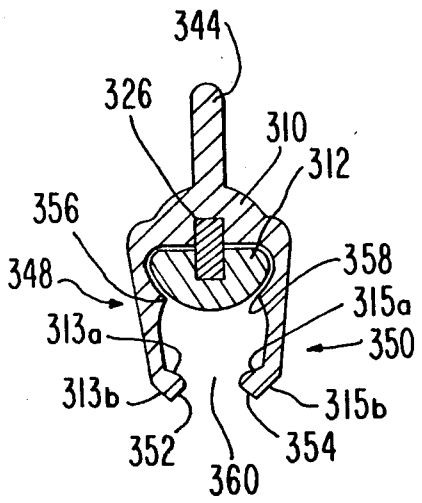
FIG. 21 is a cross-sectional view along the lines 21—21 in FIG. 18.

Similar to the construction shown in FIG. 14, the rods have guide grooves 316 and 318 (FIG. 19) on their mating flat surfaces 320 and 322. When the rods assembled face-to-face, these grooves from a closed rectangular guide slot 324 (FIG. 19). Slot 324 runs for about 9/10 the length of the rods. In one embodiment the rods were 33.6 cm long (horizontal length) and slot 324 was 29.8 cm long and started 3.8 cm from the proximate end (horizontal length). The grooves are shallower in their first third, i.e., the straight portion of the bougie. Specifically, they are about 1.5 mm deep in the first third of the bougie and about 2.0 mm deep for the rest of the bougie.

A central rod 326 is inserted into slot 324. In distinction to the previous embodiment of the invention, central rod 326 has several camming or wedging elements. In the illustrated embodiment two such elements (328 and 330) are shown. These two wedging elements or lobes are used for providing uniform expansion of the bougie over its entire working length. First wedging element 328, closer to the distal end, has two camming lobes, 332 and 334, which project in opposite directions radially and slightly offset with respect to one another axially. Rod 326 is about 29.3 cm long and has a rectangular cross section about 3.0 mm×2.0 mm. Wedging elements 332 and 334 are triangular in shape and have a height of about 4.5 mm and a base length of about 14 mm.

Rods 310 and 312 have respective side through holes 336 and through which lobes 332 and 334, respectively, project radially outwardly, beyond the peripheries of the rods.

Wedging element 328 provides expansion essentially of the front or proximal part of the bougie. Its rear or distal part is expanded by means of a wedging element 330 which has symmetrical lobes 340 and 342 which are not offset axially.

At its rear or proximate end, top rod 310 has an L-shaped projection 344 which serves as a holder or a handle for the urologist and at the same time as a pointer (FIG. 18*a*) which indicates the degree of expansion of the bougie, as will be explained later. Handle projects up about 2.2 cm and its horizontal portion is about 6.8 cm long.

On the side of rod 310 diametrically opposite to handle 344, are two projections 348 and 350 (FIG. 21) which in cross section form a U-shaped configuration. On their free ends, projections 348 and 350 have inwardly directed ears 352, 354, and in their central part projections 348 and 350 have inwardly directed ribs 356, 358. Projections 348 and 350 are about 1.8 cm long (vertical dimension in FIG. 21), have an overall width of about 1.5 cm (horizontal dimension in FIG. 21) and are about 0.8 cm wide (horizontal dimension in FIG. 18). Ribs 356 and 358 are about 1.0 mm high and are about 0.8 cm long.

The inside of projections 348 and 350, above ribs 356 and 358, form a guide slot for rods 310 and 312 when they are assembled and form a complete circle in their cross section.

Projections 348 and 350 are sufficiently elastic so that rod 312 can be pulled down past ribs 356 and 358 and into the lower space between the ribs and ears 352 and 354. However, gap 360, between ears 352 and 354, is small enough to keep rod 312 from passing beyond the ears under gravity but allows its intentional withdrawal and insertion. For this purpose, camming surfaces 313*a* and 313*b* are formed on both sides of lug 352, and similar camming surfaces 315*a* and 315*b* are formed on lug 354.

Rod 312 is shorter than rod 310 and terminates approximately slightly beyond projections 344 and 348. I.e., rod 312 is about 27.3 cm long, while rod 310 is about 29.8 cm long. In their assembled state, rods 310 and 312 have a diameter of about 0.7 cm.

Figure 20:
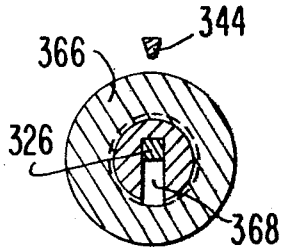
FIG. 20 is a cross-sectional view along the lines 20—20 in FIG. 18.

Part 362 of rod 310, adjacent and to the rear of handle 344, has a through opening 364 for projection 340. At its rear end, which follows directly after part 362, rod 310 has a threaded portion 366. As shown in FIG. 20, threaded portion 366 has a longitudinal slot 368 which is cut from its inner surface into the body of portion 366. Slot 368 is about 15 mm long about 2 mm wide, and about 14 mm deep. This slot serves as a guide for central rod 326 and allows rod 312 to be inserted and withdrawn.

Figure 18A:
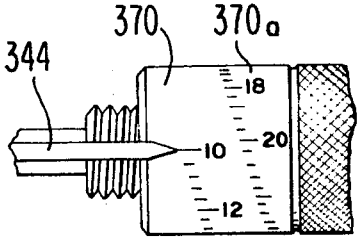
FIG. 18*a* is a partial top view of the bougie of FIG. 18 showing the position of a pointer with respect to the scale.

Threaded onto portion 366 is a cylindrical head 370 which has an inner thread 372 which mates with the thread on portion 366. The outer surface of head 370 has a scale 370*a* (FIG. 18*a*). The free end 346 of handle 344 serves as a pointer (FIG. 18*a*) to indicate the degree of expansion of the bougie. This is possible because the degree of rotation of head 370 is proportional to axial displacement of wedging elements 328, 340, and thus to the degree of radial expansion of the bougie. The scale on head 370 may be calibrated in French units (one unit=0.33 mm) which are normally used for indcating the sizes of bougies.

Near its rear end, central rod 326 has a collar 376 which rests on a support surface 378 in the threaded bore 380 of cylindrical head 370. The rear end of central rod 326 projects beyond its collar and head 370 and has a collet-like split part 381 which, when squeezed, can pass through rear end hole 382 in head 370. This allows for insertion and extraction of central rod 326 when assembling and disassembling the instrument.

Split part 381 has, on its side which faces the rear end of head 370, an abutting convex surface 386, and mating concave recess 388 is formed in the mating surface of head 370.

Figure 22:
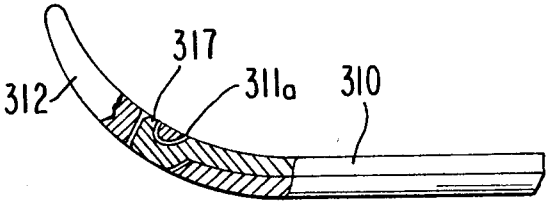
FIG. 22 is a side partially-sectional view of the proximate end of the bougie showing the structure of pivotal connection between the rods.
Figure 23:
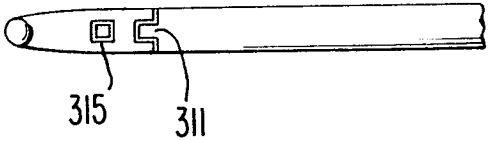
FIG. 23 is a top view of the part of the bougie shown in FIG. 22.

Rod 310 can be disconnected from rod 312, as shown in FIGS. 22 and 23. FIG. 22 is a side, partially sectional view and FIG. 23 is a top view of the attachment.

In the embodiment shown, rod 310 has at its proximate end a tongue 311 which is narrower than the body of the rod (FIG. 23). Tongue 311 has an inclined groove 311*a* (FIG. 22) so that in its side view the proximate end of rod 310 has an oblique, U-shaped configuration.

The mating part of rod 312 has a square opening 315 into which a tooth 317 formed by the front leg of the U-shaped portion of rod 310 is inserted. Inclination of groove 311*a* provides a camming action which interlocks the rods, even when an alternating axial force is applied to them for expansion of the bougie.

If the bougie is made of plastic, both rods 310 and 312 can be connected by adhesion or thermal fusion. A plastic bougie can be made cheaply enough to be disposed after one use, thereby avoiding any need for sterilization.

In addition, the plastic bougie may be cured so that it is softer and more elastic in its front end (i.e. in the curved portion at the left in FIG. 18) than in the remaining part. As a result, the front or curved part functions as a leader which facilitates insertion of the bougie into the urinary bladder through the urethra.

FIGS. 18 TO 23—OPERATION

In use, the sterilized and assembled bougie, which is in the state shown in FIG. 18, is inserted into the urethra. The bougie can be easily moved forward until protruding lobes 332 and 334 come into contact with the urethral stricture. The moment of contact of lobes 332 and 334 with the stricture can be distinctly felt by the urologist and this will be a signal that the expansion operation should be commenced.

To accomplish this, cylindrical head 370 is manually rotated so that its threads 372 mate to a greater extent with those on portion 366 of rod 310. Since surface 378 of head 370 is in contact with collar 376, rotation of head 370 will push central rod 326 forward so that its front wedging elements 332 and 334 and its rear wedging elements 340 and 342 move rods 310 and 312 apart, expanding the bougie and thus dilating the stricture of the urethra. The degree of expansion is determined by position of handle 344 with respect to scale 370*a* on the surface of head 370.

Since rod 312 is shorter than rod 310 and does not reach head 370, expansion of the bougie will not concentrate stress at the front end of the head. The use of two wedging elements provides uniform expansion of the bougie over its entire length.

It will be understood by those skilled in the art that more than two wedging elements can be used.

For withdrawal of the bougie from the urethra, the urologist reverses rotation of head 370 so that depression 388 contacts abutting surface 386 on the front side of split part 380. As a result, thrust developed by head 370 is transmitted to core rod 326 which moves back and allows rods 310 and 312 to return to their initial or contracted state. The bougie is then extracted.

If the bougie is made of metal, it is then disassembled and sterilized. For this purpose, head 370 is rotated so that threaded portion 316 of rod 310 is unscrewed from cylindrical head 370 while split part 380 is squeezed and pulled through hole 382 in the head.

After unscrewing head 370 from the probe, rod 312 is separated from rod 310 by turning rod 310 with respect to rod 312 on tooth 317 as a fulcrum point. Then tooth 317 of rod 310 is removed from opening 315 of rod 312.

During rotation, rod 312 is pulled through and snaps past ribs 356 and 358 and then through gap 360 formed by ears 352 and 354. Central rod 326 is removed by passing it through longitudinal slot 368 in the threaded part 366 of the rear end of rod 310. After sterilization, the bougie is assembled in reverse order. Since the rods can be disconnected, cleaning and sterilization procedures are improved and facilitated.

SYNOPSIS, RAMIFICATIONS, AND SCOPE

As has been shown, our invention provides bougies with mechanically-expandable probes for treating diseases, especially in the urethra and the neck of the urinary bladder. It is efficient in operation, universal in use, simple to manufacture, and easy to control. Since the bougie has a diameter corresponding to the thinnest bougie of a conventional set, it can be inserted into the urethra with minimized pain.

The bougies can be used to provide vibrational and massaging actions for strictures and other diseased portions of the urethra and surrounding tissue. This is very desirable for reducing lesions, making it even possible to treat patients suffering from impotence and other related diseases. This was impossible with conventional bougies. Moreover, the chances of complications are greatly reduced since the bougie of the invention will have far less tendency to traumatize the urethra. In addition, the bougie can be used for dilatation of nephrostomic fistulae.

It is obvious that many other modifications of the bougies are possible. For example, only one of the rods of the actuating unit may be movable. Cam or eccentric-type mechanisms can be used instead of the crank mechanism shown in the illustrated embodiments. The bougie can be made of materials other than plastic or stainless steel, and the cams can be located in the vicinity of the tip or in any other place on the rods. Also, while the bougie has been discussed for use in urological applications, it and other probe-like instruments (also referred to as bougies in the claims) can be used in many other applications, including non-human animals or inanimate objects, where an expandable probe is desired. e.g. the bougie can be used for vascular dilation in cranial, cardiac, and extremety applications. Also it can be employed in any conduit or duct in mechanical, plumbing, and laboratory applications and the like where constriction, stenosis, or wall fusion of any lumen is encountered. Dimensions, where given, are those presently preferred, but those skilled in the are will envision many variations.

Therefore the scope of the invention should be determined, not by the examples given, but by appended claims and their legal equivalents.

We claim:

1. A mechanically-exandable bougie comprising:

radially-expandable probe means formed by a pair of rods, each having a semicircular cross-section, said rods forming a complete circle in their cross section in an assembled state of said bougie, said rods being pivotally connected to each other at a front end of each of said rods, said rods having at the rear ends thereof a thread on one of said rods and a plain portion on the other rod having a smaller radius than the inner diameter of said thread, a pair of longitudinal, diametrically-opposed grooves formed on mating inner surfaces of said rods, said rods having a pair of aligned holes through their walls in the front portion of said bougie and within said grooves, the depth of said grooves from said holes to the front end of said bougie being shallower than between said holes and said rear ends thereof, and a sleeve having an inner thread engageable with said thread on said one of said rods.

2. The bougie of claim 1 further including a longitudinal core element with a wedge portion on its front end, said longitudinal element having cross section corresponding to said grooves and being positioned within said grooves with said wedge portion in said holes so that in the assembled state of said rods, said grooves form a guide slot for said longitudinal core element, said wedge portion having a width exceeding the diameter of said rods in cross-section so that the edges of said wedge portion protrude beyond the peripheries of said rods, and a shoulder on the other end of said core element; and wherein said sleeve has a hole at one end thereof which has a diameter smaller than said shoulder of said core element.

3. A mechanically-expandable bougie according to claim 2 wherein said core element has a thread on the end thereof opposite to said wedge element, and a nut screwed onto said thread in order to facilitate returning of said core element into its initial position before extraction of the bougie from the urethra.

4. A mechanically-expandable bougie according to claim 1 wherein said holes in the walls of said rods are located at a distance of $\frac{1}{8}$ to $\frac{1}{3}$ of the length of the rods from their point of interconnection.

* * * * *